US005951002A

United States Patent [19]

Yokota

[11] Patent Number: 5,951,002

[45] **Date of Patent: *Sep. 14, 1999**

[54] SHEET SUPPLYING APPARATUS WITH WEIGHT DETECTION FEATURE

[75] Inventor: Masahiko Yokota, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/610,936

[22] Filed: Mar. 5, 1996

[30] Foreign Application Priority Data

Mar. 7, 1995 [JP] Japan ..... 7-047238

[51] Int. Cl.[6] ..... B65H 3/06

[52] U.S. Cl. ..... 271/117; 271/121; 271/127; 271/160

[58] Field of Search ..... 271/117, 121–125, 271/160, 165, 127, 126

[56] References Cited

U.S. PATENT DOCUMENTS 3,869,116 3/1975 Kroeker ..... 271/165 X
4,147,341 4/1979 Wurscher et al. ..... 271/127 X
4,458,890 7/1984 Kawazu ..... 271/121 X

FOREIGN PATENT DOCUMENTS 116437 5/1987 Japan ..... 271/121
5-201558 8/1993 Japan .

*Primary Examiner*—Boris Milef
*Attorney, Agent, or Firm*—Fitzpatrick, Cella, Harper & Scinto

[57] ABSTRACT

A sheet supplying apparatus includes a stacker on which a plurality of sheets can be stacked as a sheet stack, a supply system for supplying the sheet on the stacker, and an adjusting system for adjusting a supplying force of the supply system in response to a shifted amount of the stacker. The stacker may be shifted dependent on a weight of the sheet stack, but independent of the thickness of the sheet stacker. Alternatively, the stacker may be shiftable in a stacking direction in response to sheet size and weight. The adjusting system may adjust the supplying force irrespective of the size of the sheets.

41 Claims, 9 Drawing Sheets

SHEET SUPPLYING APPARATUS WITH WEIGHT DETECTION FEATURE

BACKGROUND OF THE INVENTION

1. Field of the Invention

The present invention relates to a sheet supplying apparatus and a reading apparatus using such a sheet supplying apparatus. More particularly, it relates to a reading apparatus such as a facsimile system for separating originals one by one and for reading the separated original. However, the present invention is not limited to the original supplying apparatus, but may be applied to a copy sheet supplying apparatus, for example. The sheet including the original, copy sheet and the like is generically referred as "sheet" hereinafter.

2. Related Background Art

In order to separate and supply stacked sheets one by one, there has been proposed a method for supplying a sheet one by one from an uppermost sheet and a method for supplying a sheet one by one from a lowermost sheet. For example, in copying machines, recording sheets are supplied one by one from an uppermost sheet; whereas, in automatic original supplying apparatuses for copying machines and facsimile systems, originals are supplied one by one sequentially from a lowermost original.

In the copying machines, generally, copied recording sheets (copy sheets) are discharged with imaged surfaces facing upside and are stacked in a reverse page sequence (i.e. from the last page toward the first page; namely, the lastly discharged recording sheet is the first page). Thus, the originals to be read are supplied from the last page. In this case, the originals stacked on an original stacking plate with imaged surface facing upside are supplied one by one from the lowermost one and the supplied original is reversely rotated (turned over). After reading, the originals are returned onto the original stacking plate while turning over the originals.

On the other hand, in the facsimile systems, since it is practical that the imaged sheets are successively transmitted to the receiver from the first page, the stacked originals are successively read in the page sequence (from the first page toward the last page). Further, in almost all of the facsimile systems, to prevent the system from becoming bulky, the original turn-over mechanism is omitted, and the originals are supplied with the imaged surfaces facing downside and are read in the page sequence, and the read originals are discharged in the page sequence.

In consideration of such background, it is practical that "the originals in the copying machine are stacked with the imaged surfaces facing upside and are supplied from the lowermost one" and "the originals in the facsimile systems are stacked with the imaged surface facing downside and are supplied from the lowermost one". Further, in order to permit the handling of a large number of originals, when the number of the originals is great, a conveying force of an original conveying roller is increased in accordance with a thickness of a sheet stack by displacing or elastically deforming an urging spring. For example, although the original is conveyed by a feed roller urged against a lower surface of the original stack or the conveying force is applied to the original by urging a pressure plate against an upper surface of the original stack, in any case, the conveying force depends upon the thickness of the original stack.

However, in the above-mentioned examples, since the original conveying force is adjusted only on the basis of the thickness of the original stack, even if the size of the original is changed, so long as the thickness of the original stack is unchanged, the conveying force cannot be adjusted in accordance with the changed original size. Accordingly, when the originals having large size are to be supplied in the same apparatus, an original separation portion must be designed to provide a greater conveying force. However, if the conveying force is increased to permit the supply of the originals having the large size, when the originals having small size are supplied, since the conveying force is too excessive, the double-feed of sheets and/or sheet jam will frequently occur. Thus, in all of the original supplying apparatuses, the number of the sheets which can be handled differs from each other depending upon the size of the original.

SUMMARY OF THE INVENTION

An object of the present invention is to provide a sheet supplying apparatus in which sheets can be properly supplied regardless of sizes of the sheets.

To achieve the above object, a sheet supplying apparatus according to the present invention includes an adjusting device capable of changing a supplying force depending upon a position of a stacking means which is changed in accordance with a weight of a sheet stack.

With this arrangement, in the sheet supplying apparatus according to the present invention, the sheets can be properly supplied regardless of sizes of the sheets.

DETAILED DESCRIPTION OF THE PREFERRED EMBODIMENTS (First Embodiment)

Figure 1:
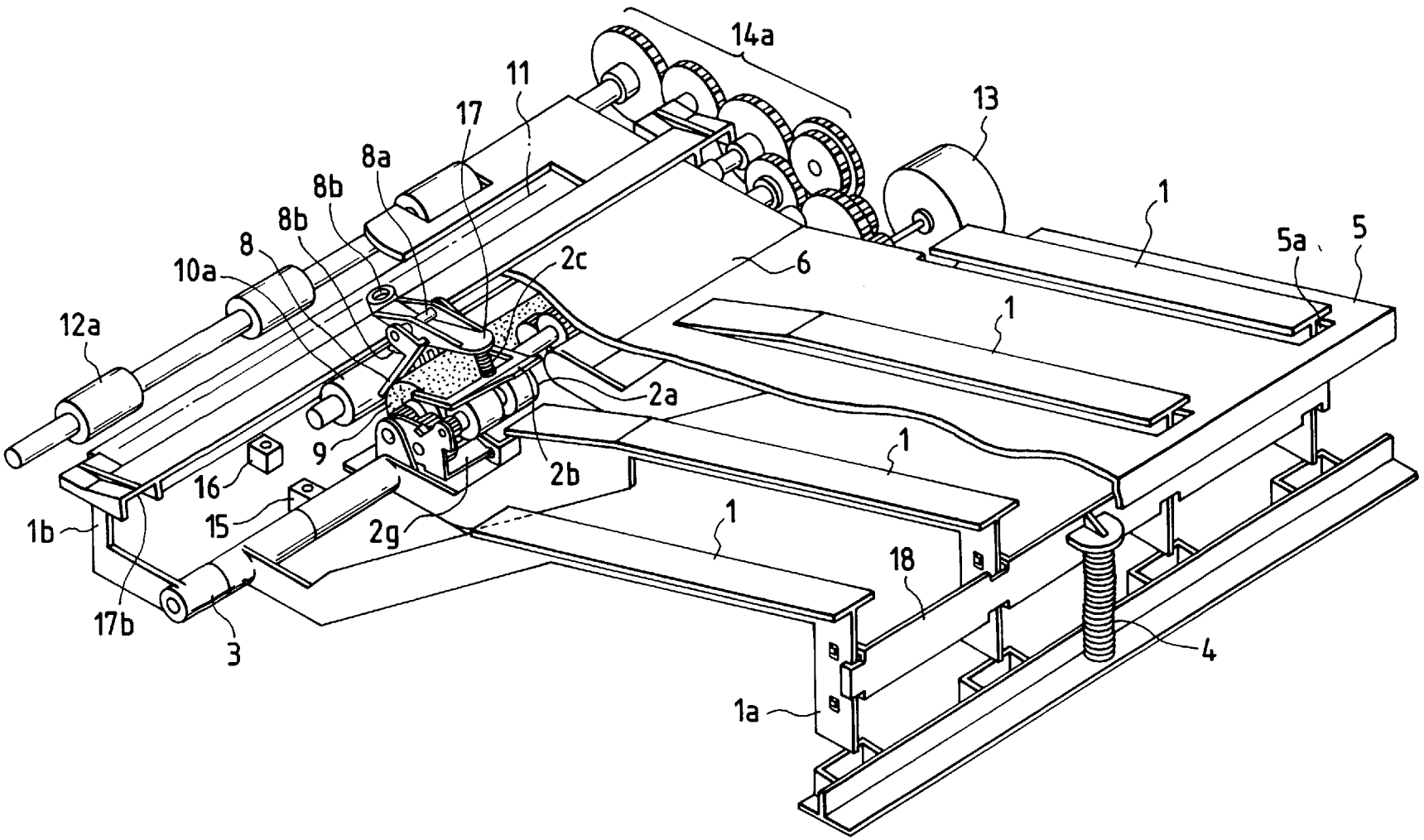
FIG. 1 is a perspective view of a main portion of a sheet supplying apparatus according to a first embodiment of the present invention.
Figure 2A:
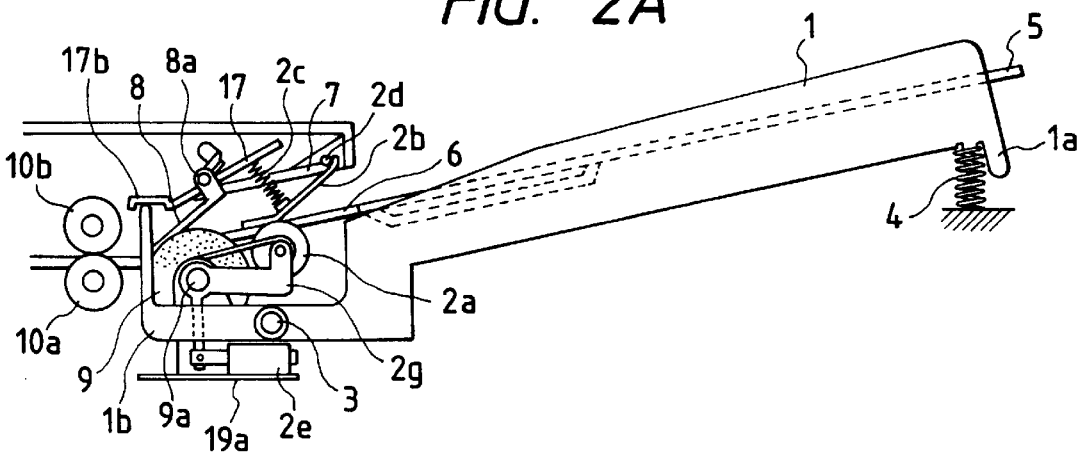
FIGS. 2A to 2D are side views for explaining an operation of the sheet supplying apparatus of FIG. 1.
Figure 2B:
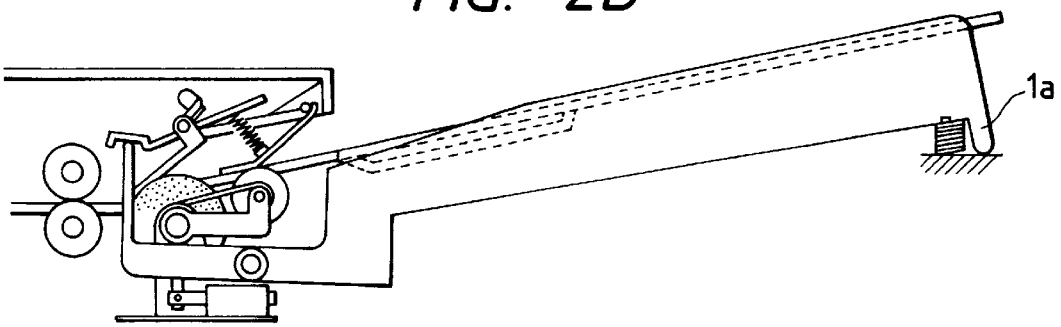
Figure 2C:
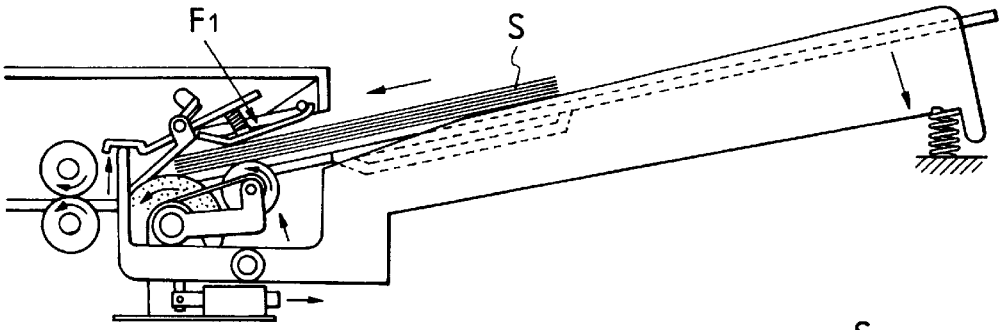
Figure 2D:
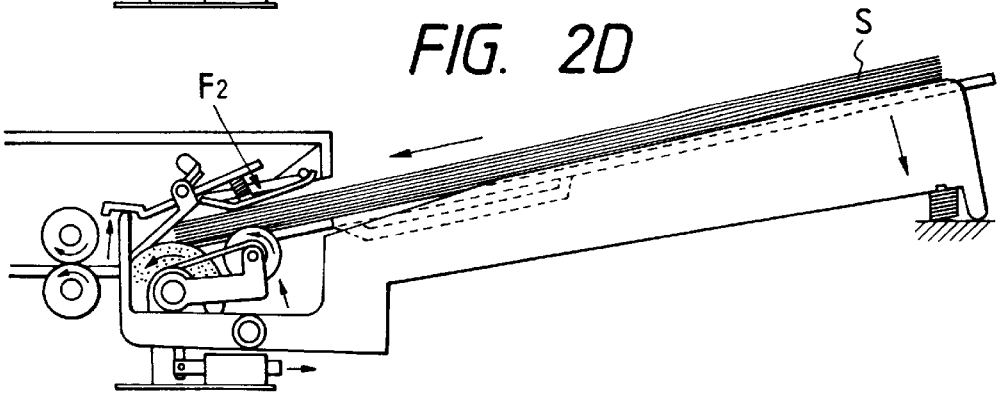
Figure 3:
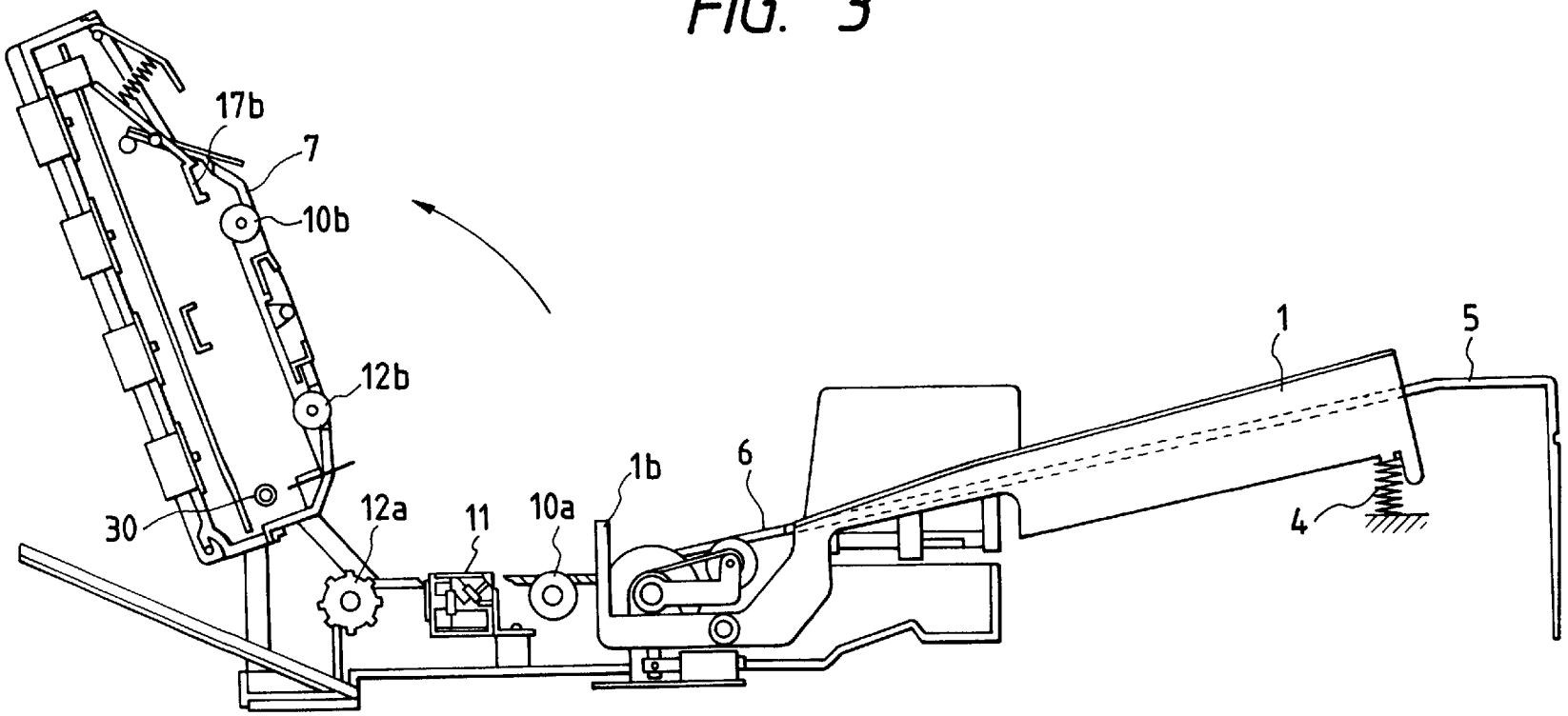
FIG. 3 is a view for explaining the handling of the sheet supplying apparatus of FIG. 1.

FIGS. 1 to 3 show a first embodiment of the present invention. A sheet supplying apparatus according to the first embodiment includes a rib-shaped original stacking means (tray) 1, each rib 1 having a T-shaped cross-section. The ribs 1 are pivotally mounted on a support shaft 3 secured to a body of the sheet supplying apparatus in the vicinity of an original feed roller 2*a*.

Further, a portion 1*a* of each rib 1 acts as a stopper for determining a lowermost position of the rib. The roller 2*a* is supported by a unit base 19*a*. A pressure plate 2*b* is urged against the original feed roller 2*a* to pinch an original stack between the roller 2*a* and the plate 2*b*, thereby feeding the original stack to a separation roller 9. The pressure plate 2*b* is pivotally mounted on a shaft 2*d* of an upper original guide 7 and is biased toward the feed roller 2*a* by a biasing spring 2*c*. The feed roller 2*a* is connected to the separation roller 9 through a belt and is rotatably supported by an arm 2*g* pivotally mounted on a shaft 9*a* of the separation roller 9. The other end of the arm 2*g* is connected to a plunger of a solenoid 2*e*. When the solenoid is activated, the feed roller 2*a* is protruded upwardly through an opening formed in a lower original guide 6 to contact with a lower surface of the original stack, thereby permitting the feeding of the original stack.

In FIGS. 2A to 2D, the reference numeral 4 denotes a spring for elastically supporting the rib-shaped tray 1; 5 denotes an original support having slits 5*a* through which the ribs 1 can be moved; 6 denotes the above-mentioned lower original guide contiguous to the original support 5; 7 denotes the above-mentioned upper original guide opposed to the lower original guide 6 to form an original convey path therebetween; 8 denotes a friction plate mounted on a support shaft 8*a* rotatably supported by the upper original guide 7 and biased toward the separation roller 9 by a biasing spring (biasing means) 8*a* and 10*a* denotes an original convey roller cooperating with a back-up roller 10*b* to pinch the original therebetween, thereby conveying the original toward a downstream side.

In FIG. 1, the reference numeral 11 denotes an original image reading means comprised of a sensor including photoelectric conversion elements; 12*a* denotes an original discharge roller for cooperating with a back-up roller 12*b* to discharge the read original; 13 denotes a stepping motor; 14*a* denotes a gear train for transmitting a driving force of the motor to the various rollers; 15 denotes an original presence/absence sensor for detecting presence/absence of the original; and 16 denotes an original edge sensor for detecting tip and trail ends of the original.

A conveying force adjusting means 17 is rotatably supported by the upper original guide 7 via the support shaft 8*a* for the friction plate 8 and has an upstream end supporting one end of the biasing spring 2*c* for biasing the pressure plate 2*b* and a downstream end protruding out of both sides of the original convey path. Both ends (of the adjusting means) protruded out of the original convey path are contacted with extensions 1*b* of the rib-shaped tray 1 extending toward the upper original guide. By the combination of the rib-shaped tray 1 and the conveying force adjusting means 17, when the rib-shaped tray 1 is lowered, the conveying force adjusting means 17 is shifted to increase the biasing force of the sheet supply biasing spring; whereas, when the rib-shaped tray 1 is lifted, the biasing force is decreased.

Incidentally, a rib connecting member 18 serves to support the ribs 1 so that the ribs are not moved at random. In FIGS. 2A to 2D, the original (original stack) is denoted by "s". Incidentally, the pressure plate 2*b* is called an "urging means", "loading means" or "weight means" and is not limited to a plate.

Figure 4:
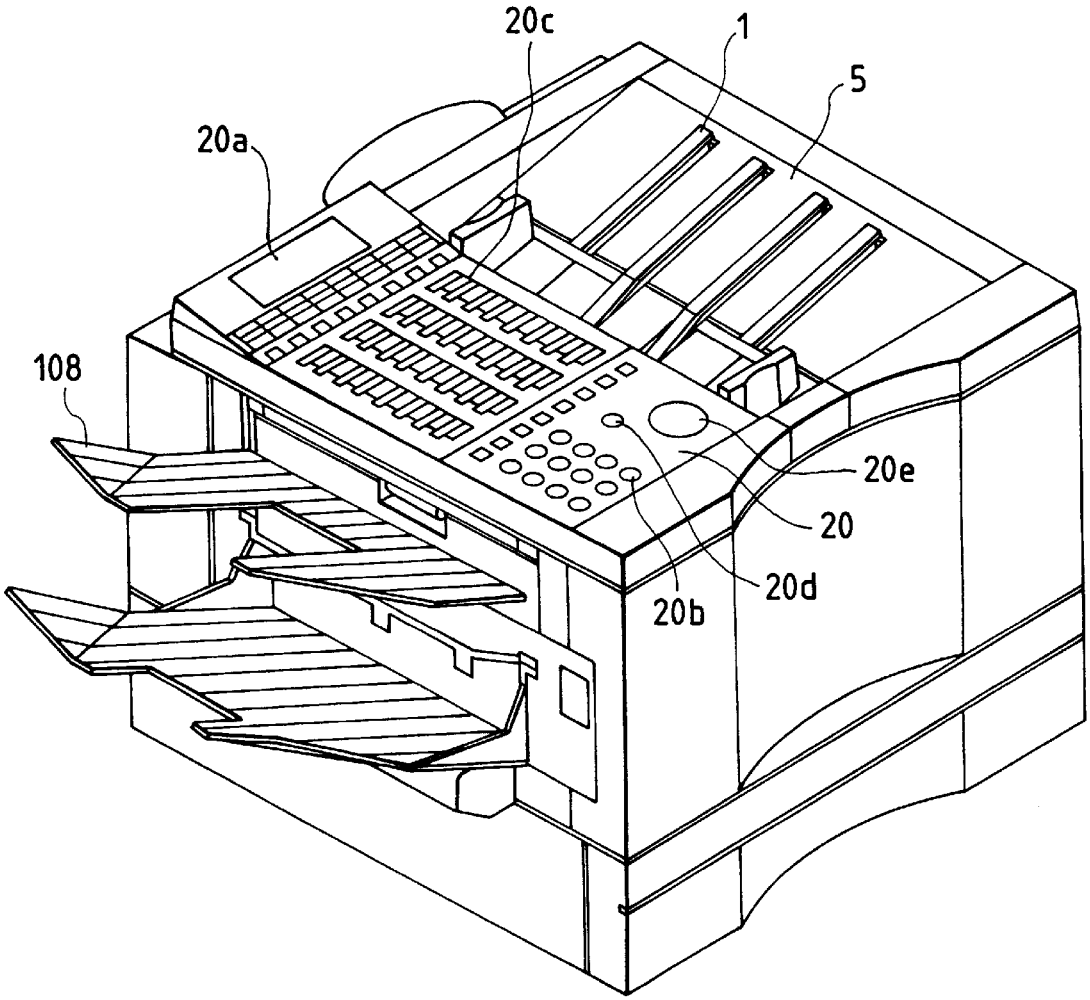
FIG. 4 is a perspective view of a facsimile system to which the sheet supplying apparatus of FIG. 1 is applied.
Figure 5:
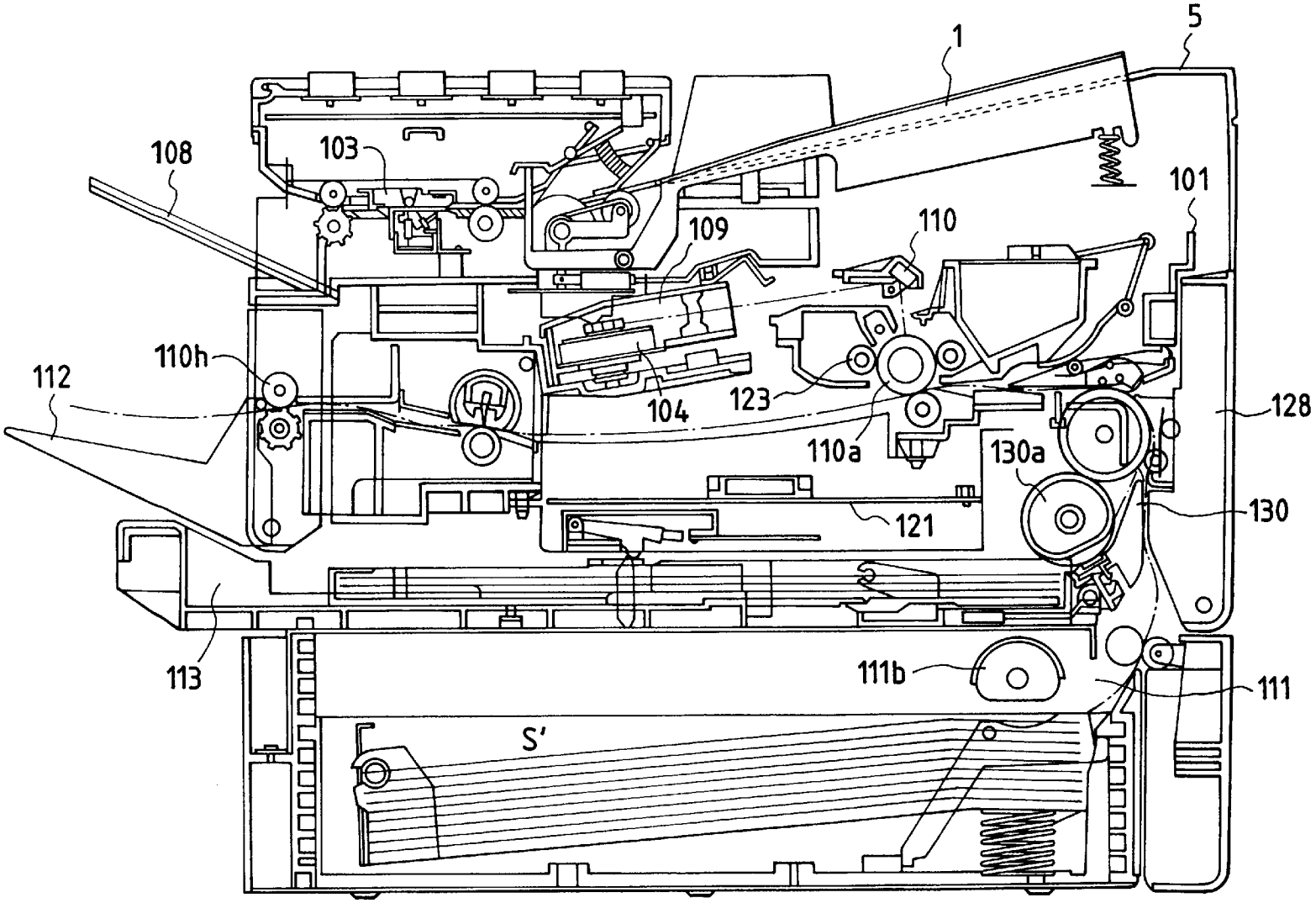
FIG. 5 is an elevational sectional view of the facsimile system.

Next, a facsimile system to which the present invention is applied will be explained. FIG. 4 is a perspective view of the facsimile system, and FIG. 5 is an elevational sectional view of the facsimile system.

In a waiting condition, as shown in FIG. 2A, the rib-shaped tray 1 is in a non-loaded condition and is biased upwardly by the spring 4, with the result that projections formed on the ribs 1 are contacted with the original support 5 (stopped condition). A condition that the rib-shaped tray 1 is further lowered is shown in FIG. 2B. In this condition, the lowermost position of the tray is limited by the stoppers 1*a*. Heights of the stoppers 1*a* are so selected that upper surfaces of the ribs 1 cannot be shifted below the original support 5, with the result that, even when the ribs 1 reach the lowermost position, the original stack on the tray is prevented from contacting the original support 5. As shown in FIG. 2B, when the rib-shaped tray 1 is in the lowermost position, the feed roller 2*a* has the greatest conveying force.

That is to say, when the original stack is set in the sheet supply portion, the ribs 1 are lowered to rock the conveying force adjusting member 17 in a clockwise direction, thereby compressing the spring 2*c*. As a result, a nip force between the pressure plate 2*b* and the roller 2*a* is increased, thereby increasing the conveying force of the feed roller 2*a*.

The four ribs shown in FIG. 1 are interconnected by the connecting member 18 at their trailing ends. The spring 4 is positioned at a central portion of the connecting member 18 to bias the ribs 1 upwardly. Each rib 1 has a T-shaped cross-section so that the rigidity of the ribs is enhanced and dirt and the like are prevented from entering into the slits 5*a* in which the ribs 1 are received.

FIG. 2C shows a condition that the original stack having a small size is set, and FIG. 2D shows a condition that the original stack having a large size is set. Since the weight of the original stack having the large size is greater than the weight of the original stack having the small size, when the original stack having the large size is set, the ribs 1 are displaced or lowered more than when the original stack having the small size is set, with the result that the biasing force of the pressure plate 2*b* opposed to the feed roller 2*a* is increased ($F1<F2$), thereby increasing the conveying force. The reason is that, when the thickness of the original stack is the same, the heavier original stack (i.e. larger size original stack) requires the greater conveying force. This is the purpose of the present invention.

Immediately after the original stack is set, the presence of the original is detected by the original presence/absence sensor 15, with the result that an original treatment waiting signal is sent to a control portion of the facsimile system. In this case, the facsimile system is in an original transmission command waiting condition or a copy command waiting condition. This condition is displayed on an LED panel 20*a* provided on an operation panel 20 (key input waiting condition). Incidentally, the reference numeral 20*b* denotes a ten-key for inputting the telephone number of the receiver; 20*c* denotes a one-touch key capable of identifying and calling the previously registered receiver's telephone number; 20*d* denotes a copy key for commanding the copying operation; and 20*e* denotes a start key for starting a selected treatment.

After the original stack is set along the original support 5, when the copying operation is performed, the copy key 20*d* is depressed or when the facsimile transmission is performed the one-touch key 20*c* corresponding to the receiver is depressed or the receiver's telephone number is dialed. Then, when the start key 20*e* is depressed, the plunger of the solenoid 2*e* shown in FIG. 2A is operated to lift the feed roller 2*a*, thereby contacting the feed roller with the lower surface of the original stack. In this way, the original stack can be conveyed by the above-mentioned conveying force. When the original stack is conveyed to the separation roller 9, the lowermost original is separated from the original stack by the friction plate 8 and the feed roller, and the separated original is conveyed toward a downstream side.

After the separated original is pinched between the sheet supply roller 10*a* and the back-up roller 10*b*, when the original is further conveyed toward the downstream side, a tip end of the original is detected by the original edge sensor 16 disposed between the sheet supply roller 10*a* and the reading 10*b*, sensor 11, with the result that the tip end of the original is fed up to a reading position. The plunger is deactivated to lower the feed roller 2*a*, thereby interrupting the conveying force of the feed roller. The reason is that the double-feed of originals, which may be caused by the excessive conveying force in the feed roller portion, is prevented.

The original is read by the image sensor 11. After the read data is binary-coded by a circuit (not shown) in the control portion, it is then stored in a memory.

When a trail end of the first original leaves the separation portion, the separation roller 9 contacts with a second original to separate the second original from the original stack. The separated second original is conveyed toward the downstream side. In this case, for example, if the friction force between the original and the roller is insufficient or if the friction between the original and the tray is too great to shift the second original, the feed roller support arm 2*g* is rotated by the solenoid 2*e* to lift the feed roller 2*a*, thereby increasing the original conveying force. The timing for activating the solenoid is determined by the detection timing of the original edge sensor 15 so that, if a distance (detected time period) between the trail end of the preceding original and the tip end of the succeeding original exceeds a predetermined value (three seconds in the illustrated embodiment), the solenoid is activated to lift the feed roller 2*a*.

As is in the first original, the second, third and other originals are successively separated, conveyed and read as mentioned above. The number of the originals stacked on the tray is gradually decreased, and the ribs 1 of the tray are gradually lifted accordingly. Consequently, the extensions 1*b* are gradually lowered, with the result that the conveying force adjusting means 17 gradually decreased the biasing force of the spring 2*c* for biasing the pressure plate 2*b*, thereby providing the proper conveying force in accordance with the original load changed depending upon the number of the originals.

When all of the originals are read and discharged onto an original discharge tray 108, the receiver's telephone number is dialed in accordance with the registration contents registered in the one-touch key, and the read data is transmitted to the receiver's facsimile.

On the other hand, in case of direct transmission, immediately after the start key 20*e* is depressed, the circuit connecting operation is started. When the circuit is connected and the pretreatments are completed, the conveyance and reading of the original are started. In this case, unlike the memory transmission, the image data for several lines are stored in a buffer (not shown), and, the image data for several lines are successively transmitted depending upon the receiver's FAX modem speed and/or the transmission circuit condition with feed-back, if necessary. The original conveying force is adjusted as mentioned above, and the last original is discharged after the transmission circuit is disconnected.

If the original is stopped on the way due to the error or if the original is jammed, as shown in FIG. 3, the upper original guide 7 is rotated around a hinge 30 in an anti-clockwise direction to open or expose the interior of the apparatus. Since the extensions 1*b* of the ribs 1 are merely contacted with the longitudinal ends 17*b* of the conveying force adjusting member 17, the original convey path can easily be exposed.

In FIGS. 4 and 5, the reference numeral 101 denotes a body of the facsimile; 103 denotes an image reading portion for reading image information on the original S; 104 denotes a recording portion comprised of a laser beam printer; 109 denotes a laser scanner; 110 denotes an image forming portion; 110*a* denotes a photosensitive drum; 111 denotes a cassette sheet supply portion; 112 denotes a recording sheet discharge tray; 113 denotes an MP (recording sheet size variable) cassette portion; 121 denotes a control portion of the facsimile system; 123 denotes a convey guide for guiding the recorded recording sheet; 128 denotes a light cover used when the recording sheet jam treatment is effected; and 130 denotes an MP separation portion.

The MP cassette portion 113 is disposed at a central lower portion of the facsimile body 101. The recording sheets contained in the MP cassette are separated one by one by an MP separation roller 130*a*. The cassette sheet supply portion 111 is disposed at a bottom of the facsimile body 101, and the recording sheets S' contained in the cassette are separated one by one by a semi-circular sheet supply roller 111*b*.

When the copying operation is performed, the recording portion is operated in synchronous with the reading portion. When it is desired that the reading time is shortened or a plurality of copies are obtained, the memory copy wherein the read images are once stored in the memory is performed. When the amount of image data is great so that the image data cannot be stored in the memory at once, as is in the above-mentioned direct transmission, the data for several lines are stored in the buffer in synchronous with the image formation speed, thereby preventing the consumption of large memory area (direct copy function).

In the copying operation, the conveying force is adjusted in response to the reduction of the number of the originals. In particular, during the copying operation, when further originals are added to the original stack, the conveying force adjusting function is performed so that the change in weight of the original stack is detected to increase the conveying force.

Figure 6:
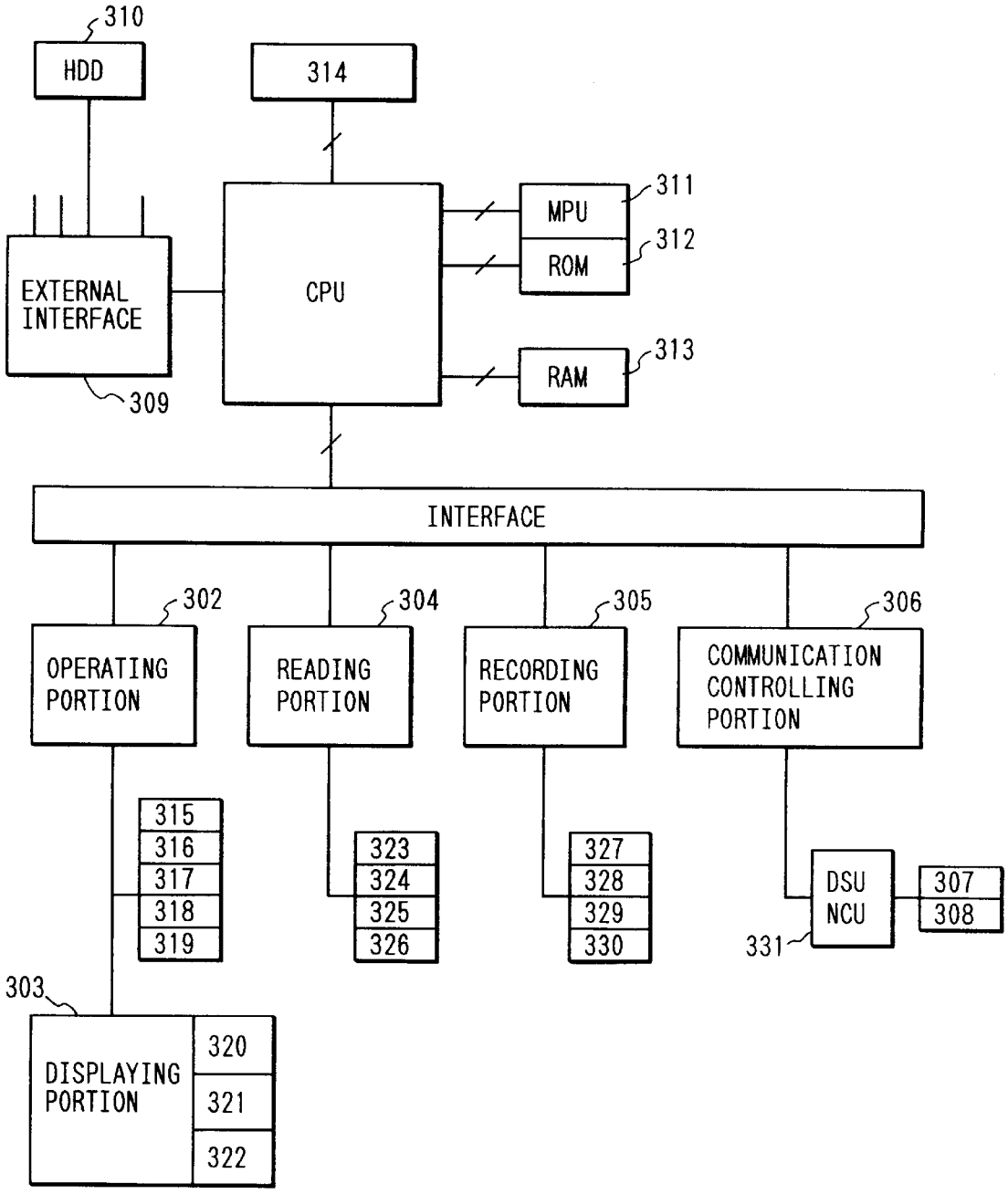
FIG. 6 is a block diagram of the facsimile system.

FIG. 6 is a block diagram of a control system 300 of the facsimile system using LBP (laser beam printer) according to the present invention. In FIG. 6, a CPU 301 serves to control the entire facsimile system and includes an MPU 311, a ROM 312 for storing the control program for the MPU 311 and the like, a RAM 313 used as a work area for various data treatment and a temporary storing portion for the image information, and an image treating portion 314 for changing the magnification of the image and converting the resolving power. The CPU is provided with known calendar and clock functions and the like. An area in the RAM 313 for storing important system setting information such as one-touch key receiver information, software switch information and the like is backed-up by a battery to protect the information from an accident such as service interruption. The control system of the facsimile is constituted by connecting the CPU 301 to the following elements 302–310 through an interface.

An operating portion 302 includes various key switches such as ten-key 314, function keys 315, one-touch keys 136, start/stop key 317 and the like. A displaying portion 303 includes an LCD 318 for displaying various messages, various LED's 319 for displaying a transmission mode and the like, and a tally lamp 320 for informing the operator of the communication condition and abnormality condition. A reading portion 304 includes a drive portion 321 such as a reading motor, a reading sensor 322 for reading the image, an image treating portion 323 for effecting the shading of the read image and the binary coding, and various sensors 324 for detecting the original and the like. A recording portion 305 includes a drive portion 325 such as a recording motor, a recording unit 326 for controlling the laser scanner and the electrophotographic process, an image treating portion 327 for effecting the smoothing of the image to be recorded, and various sensors 328 for detecting the recording sheet and the like. A communication controlling portion 306 for effecting the calling, the receiving and the coding of the image data has a connecting portion 329 comprised of DSU, NCU and the like, which connecting portion is connected to a communication network 307 and a handset 308. A CPU external interface 309 is an interface for effecting direct data communication with the CPU 301. Thus, when the interface 309 is connected to an external computer through RS232C, SCS 1, LAN or the like, the system can be used as a scanner printer for the external computer. An HDD 310 is used as a large volume nonvolatile memory for storing the image information and the like.

(Second Embodiment)

FIGS. 7A to 7D show a sheet supplying apparatus according to a second embodiment of the present invention. In this embodiment, the unit base 19*a* supporting the separation roller 9 has a shaft on which a pendulum member 19 is rotatably mounted, and the solenoid 2*e* is secured to the pendulum member 19. The pendulum member 19 is provided with a slot 19*b* which receives a boss 1*d* formed on the end of the rib-shaped tray 1. The boss can be slid along the slot 19*b*. Accordingly, the arm 2*g* is revolved together with the pendulum member 19 and is rotated by the solenoid 2*e*.

Figure 7A:
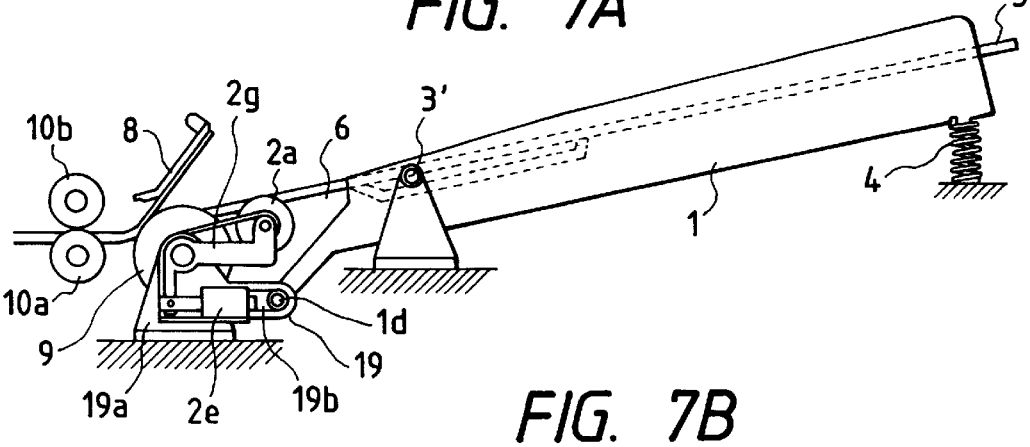
FIGS. 7A to 7D are side views for explaining an operation of a sheet supplying apparatus according to a second embodiment of the present invention.
Figure 7B:
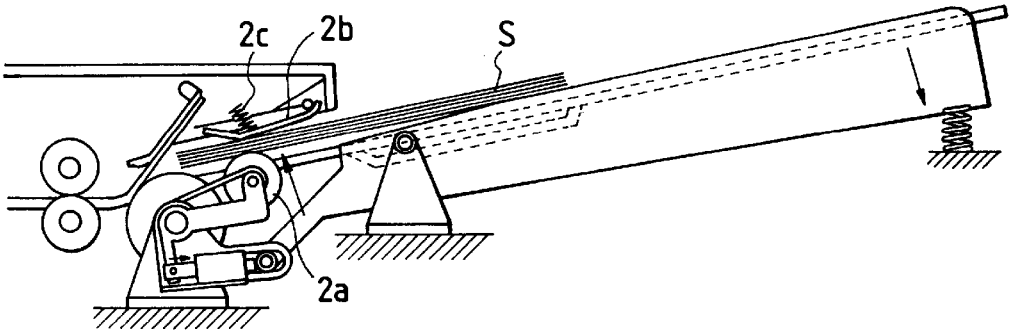

FIG. 7A shows a waiting condition. In this condition, the feed roller 2*a* is positioned below the original support 5 and the ribs 1 are in the uppermost position. FIG. 7B shows a condition in which the feed roller 2*a* is lifted by rotating the pendulum member 19 in an anti-clockwise direction by the insertion (setting) of the original stack having small size. Of course, the solenoid 2*e* is activated to rotate the arm 2*g* in the anticlockwise direction, thereby providing the original supply permitting condition.

Figure 7C:
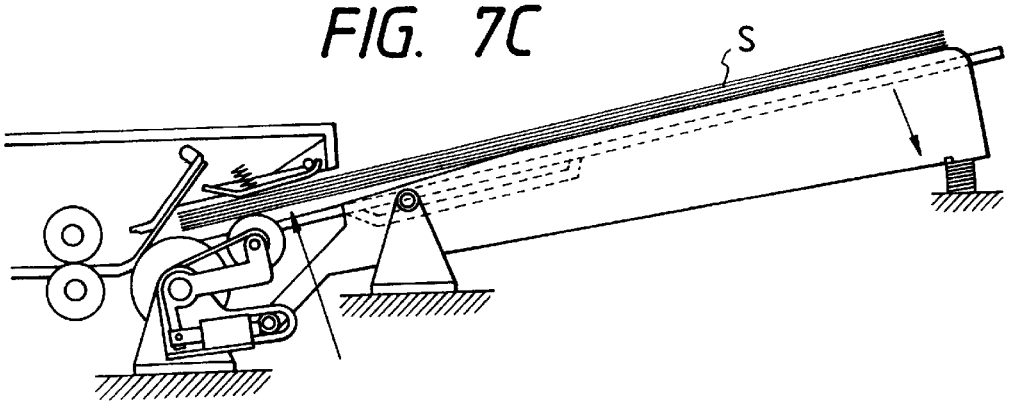

FIG. 7C shows a condition in which (in place of the original stack having small size) the original stack having large size is inserted or set. In this case, since the weight of the original stack is heavier (in comparison with the original stack having small size), the ribs 1 are further lowered accordingly. As a result, since the pendulum member 19 is further lifted, the feed roller 2*a* is further lifted, thereby increasing the conveying force. With this arrangement, as is in the first embodiment, the greater conveying force can be obtained in comparison with the original stack having small size.

Figure 7D:
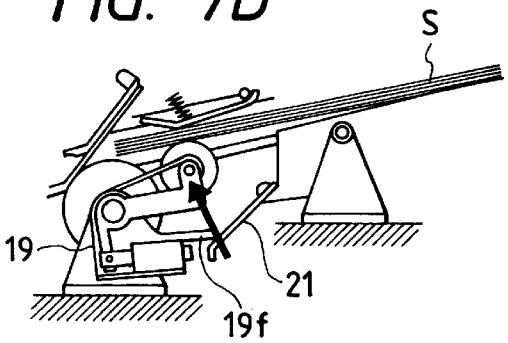

FIG. 7D shows an alteration wherein a leaf spring 21 is provided at a downstream end (insertion end) of the rib-shaped tray 1 and a free end of the leaf spring 21 is engaged by an end 19*f* of the pendulum member 19. With this arrangement, the original biasing force of the original feed roller 2*a* (shown by the arrow) can be adjusted.

As mentioned above, in the second embodiment, the apparatus can be made compact by controlling the position of the feed roller 2*a* so that the feed roller does not move out of the original convey path.

(Third Embodiment)

FIGS. 8A to 8D show a third embodiment of the present invention in which a photo-interrupter is used.

Figure 8A:
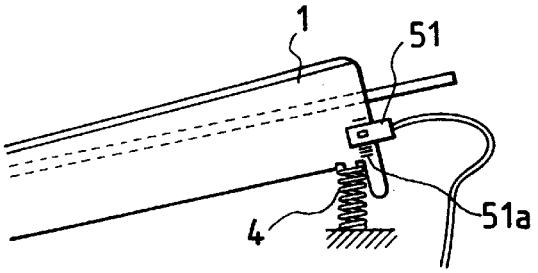
FIGS. 8A to 8D are views showing an original weight detection means and an original conveying force adjusting means of a sheet supplying apparatus according to a third embodiment of the present invention.

In the third embodiment shown FIG. 8A, a plurality of slits 51*a* overlapped in a vertical direction are formed in the rib 1, and a photo-interrupter 51 is disposed to sandwich the slits 51*a*. The photo-interrupter 51 is secured to the original support 5 or the body of the apparatus. As the rib 1 is lifted, by counting the number of the slits, the original conveying force adjusting means is driven by a motor or a plunger to gradually decrease the original conveying force. This method is effective to an apparatus in which a lever mechanism cannot be adopted due to a spacial problem caused by the arrangement of original support, original convey path and drive system.

Figure 8B:
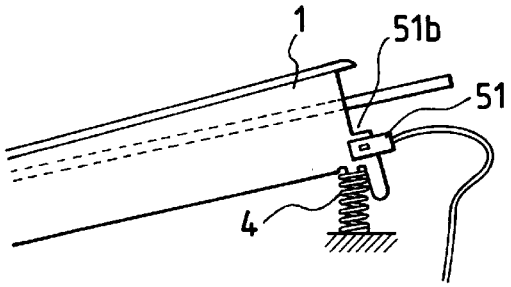

FIG. 8B shows an alteration in which, in place of multi-stage adjustments for the conveying force, the conveying force is adjusted with only two stages ("increase" or "decrease"). To this end, a single step 51*b* is formed on the rib 1, and the photo-interrupter 51 only detects whether the step 51*b* of the rib is in a high level (than the photo-interrupter) or in a low level (than the photo-interrupter). On the basis of the difference in level, the adjusting value of the conveying force adjusting means is changed to "strong" or "weak". With this arrangement, when the weight of the original stack is increased by adding the additional originals, the conveying force can be adjusted to "strong".

Figure 8C:
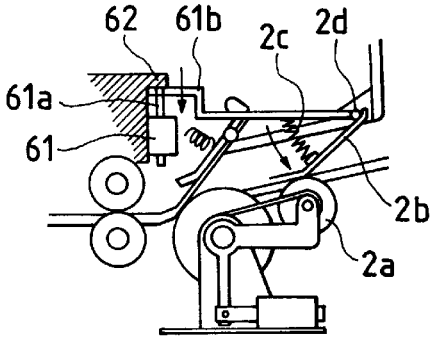
Figure 8D:
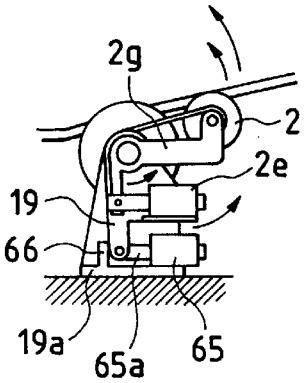

FIGS. 8C and 8D show examples of original conveying force adjusting means capable of changing the conveying force in response to the original weight detecting means. In FIG. 8C, a solenoid 61 is fixed to a part of the upper original guide and a plunger 61*a* of the solenoid is connected to an auxiliary urging member 61*b* pivotally mounted on a support shaft coaxial with the support shaft 2*d* of the pressure plate 2*b* so that the pressure plate 2*b* is biased by the auxiliary urging member 61*b* via a biasing spring (compression coil spring) 2*c*.

When the original weight detecting means judges that the weight of the original stack is small, the solenoid 61 is deactivated by a control circuit of the facsimile system, thereby releasing the biasing force acting on the pressure plate 2*b*. When released, an extreme position of the auxiliary urging member 61*b* is regulated by a stopper 62 formed on the upper original guide. On the other hand, when the original weight detecting means judges that the weight of the original stack is great, the solenoid 61 is activated to pull the plunger 61*a*, thereby rotating the auxiliary urging member 61*b* to increase the biasing force of the pressure plate 2*b*.

FIG. 8D shows an example in which such an action is applied to the feed roller side. That is to say, a pivotal end of the pendulum member 19 is connected to a plunger 65*a* of a solenoid 65 (fixed to the unit base 19*a*). With this arrangement, when the original weight detecting means judges that the weight of the original stack is small, the solenoid 65 is deactivated by the control circuit of the facsimile system, thereby lowering the feed roller 2*a* to decrease the conveying force. On the other hand, when the original weight detecting means judges that the weight of the original stack is great, the solenoid 65 is activated to pull the plunger 65*a*, thereby rotating the pendulum member 19 to increase the conveying force of the feed roller 2*a*.

(Fourth Embodiment)

Figure 9:
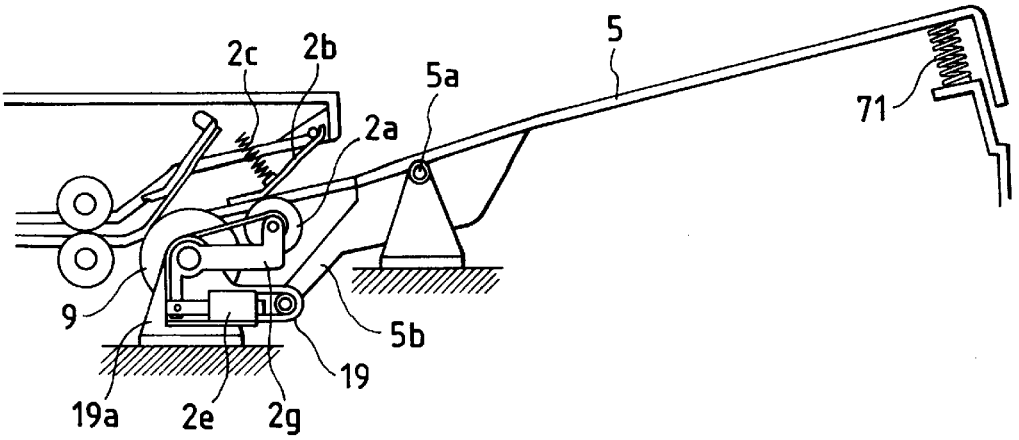
FIG. 9 is a view showing a sheet supplying apparatus according to a fourth embodiment of the present invention.

In a fourth embodiment of the present invention, the original stacking plate itself is used as the original weight detecting means. As shown in FIG. 9, a fulcrum 5*a* is provided in the vicinity of the downstream end (original stack insertion end) of the original stacking plate (original support) 5 and the original support is pivotally supported by the fulcrum 5*a* for rocking movement with respect to the body of the apparatus. The other end of the original support 5 is supported by a spring 71.

With this arrangement, when the level of the original support 5 is changed in depending upon the weight of the original stack, as is in the second embodiment, the original conveying force can be adjusted by changing the level of the feed roller 2*a*. On the other hand, as is in the first embodiment, the biasing force of the original biasing means can be adjusted in synchronous with the change in level of the original support by using the lever mechanism, or, as is in the third embodiment, the level of the original support 5 can be detected by using the sensor. In this fourth embodiment, the original weight detecting means can be obtained by a smaller number of the parts, and the assembling can be facilitated.

(Fifth Embodiment)

Figure 10A:
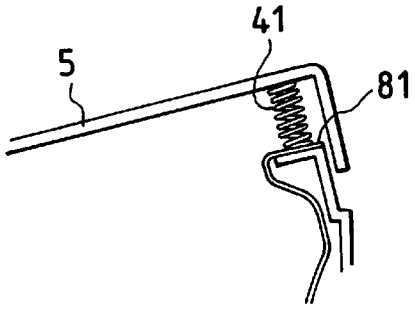
FIGS. 10A and 10B are views showing a fifth embodiment of the present invention.
Figure 10B:
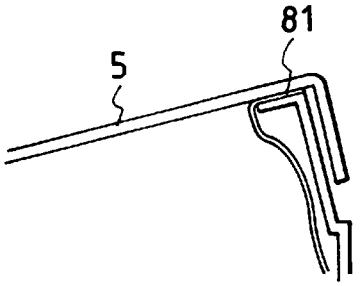

In a fifth embodiment of the present invention, as shown in FIG. 10A, a piezo-electric element 81 is disposed between a spring 41 supporting the original support 5 and the body of the apparatus. On the other hand, in an alteration shown in FIG. 10B, the original support 5 is directly supported by the piezo-electric element 81.

An urging force of the original support 5 urging the piezo-electric element 81 is changed depending upon the weight of the original stack, with the result that potential emitted from the piezo-electric element 81 is changed accordingly. The change in potential is detected by the control circuit of the facsimile system. On the basis of the change in potential, the conveying force is adjusted by controlling the original conveying force adjusting means by means of a motor (or a plunger of a solenoid). Although the electrical means is similar to the third embodiment (FIGS. 8C and 8D), in this embodiment, minute change in weight of the original stack can be detected, thereby permitting more accurate original conveying force adjustment.

(Sixth Embodiment)

Figure 11A:
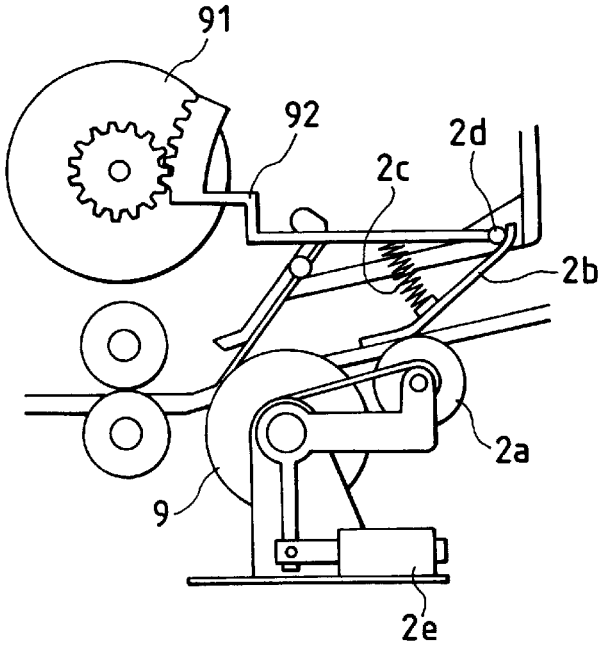
FIGS. 11A and 11B are views showing a sixth embodiment of the present invention.
Figure 11B:
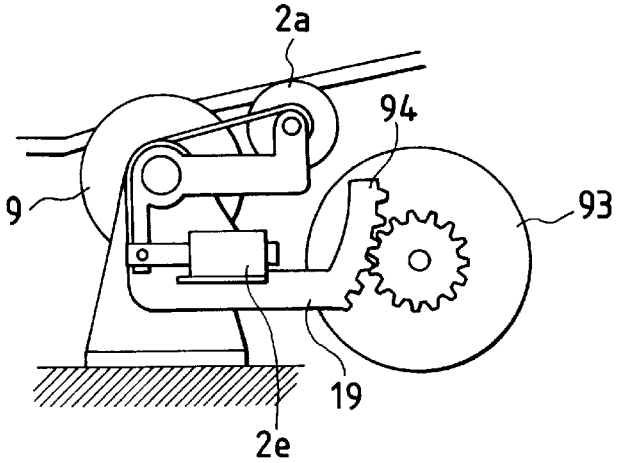

A sixth embodiment of the present invention relates to the original conveying force adjusting means. As shown in FIG. 11A, an auxiliary urging member 92 having a rack is rotatably mounted on a support shaft 22*d* of the pressure plate 2*b*, and a biasing spring 2*c* is positioned between the auxiliary urging member 92 and the pressure plate 2*b*. The rack is connected to a motor 91 so that the biasing force of the pressure plate 2*b* is adjusted by shifting the rack by means of the motor. FIG. 11B shows an alteration in which the above mechanism is positioned at the feed roller side. That is to say, a rack 94 is formed on the end portion of the pendulum 19 and the rack is connected to a motor 93.

Although the electrical means is similar to the third embodiment, in this embodiment, a minute change in original conveying force can be affected, thereby permitting more accurate original conveying force adjustment. This embodiment can be used as the electrical means other than the third and fifth embodiments.

Incidentally, according to the above-mentioned embodiments, while an example in which the stacking means itself or the rib-shaped stacking means is shifted was explained, a means for exclusively detecting the weight of the original stack may be provided on the stacking means and may be connected to the adjusting means electrically or mechanically. That is to say, it is sufficient that even when only a part of the original stack is rested on a member, the weight of the original stack can be detected by the displacement of such a member.

As mentioned above, according to the illustrated embodiment, the weight of the original stack is detected by the original convey means, and the adjustment associated with the weight of the original stack is mechanically controlled. In this embodiment, the weight of the original stack is converted into the change in level of the original supporting (stacking) means, i.e., dynamical change is converted into mechanical change.

The position detecting means comprises a photo-interrupter cooperating with the slits formed in the original stacking means. The passing of each slit is detected by the photo-interrupter to detect the-change in level of the original stacking means. That is, the change in weight of the original stack is electrically detected, with the result that the change in weight can be treated in the control circuit as electric signals.

By providing the fulcrum in parallel with the convey roller in the vicinity of the original supply portion positioned below the original convey path and by rotatably supporting the original support around the fulcrum and by elastically supporting the original support at a point spaced apart from the fulcrum, the weight of the original stack can be detected regardless of the size of the original, and the number of the parts can be reduced.

When the original weight detecting means comprises the piezo-electric element, since the piezo-electric element is positioned between the original stacking means and the elastic member elastically supporting the original stacking means or between the elastic member and the apparatus body to which the elastic member is attached or between the original stacking means and the apparatus body so that the weight of the original stack on the original stacking means is detected as the displacement of the piezo-electric element, the detected weight can be treated electrically to permit the compactness of the apparatus and the minute weight change can also be detected.

When the original stacking means is constituted by the ribs, since the ribs are slidably received in the slots (extending along the original conveying direction) formed in the original support fixed to the apparatus body and the ribs are supported by the elastic member provided on the lower surface of the original support or provided on the apparatus body, the weight of the original stack can be detected with a cheaper arrangement while enhancing the rigidity around the original support, and the contact area between the original and the original support can be reduced, thereby decreasing the original conveying load.

By providing the fulcrum in parallel with the convey roller in the vicinity of the original supply portion and by rotatably supporting the ribs around the fulcrum, the lower original guide can be connected to the original stacking means smoothly, with the result that the original stack can be directed to the supply portion while contacting the original stack with the lower original guide, thereby ensuring the constant contact position of the original stack with respect to the feed roller.

Since at least two ribs not integral with the original support are provided, the original stack can be prevented from contacting with the original support, so that the entire weight of the original stack can be supported by the ribs. Since the ribs are interconnected to be shifted along the vertical direction in parallel with each other, the skew-feed of the original can be avoided due to the synchronous movement of the ribs. Since each rib has the T-shaped cross-section, the dirt and the like can be prevented from entering into the apparatus through the slots of the original support, and the rigidity of the ribs can be enhanced.

In the original supplying apparatus having the separation means for separating and conveying the original, and the original supply means disposed at the upstream side of the separation means and adapted to supply the original stack to the separation means, in order to convey the original stack inserted between the feed roller and the opposed original biasing means, by providing the conveying force adjusting means capable of changing the original conveying force regardless of the thickness of the original stack, as well as the original biasing force for increasing the conveying force by increasing the original biasing force in proportion to the thickness of the original stack, the original conveying force can be made optimum regardless of the thickness of the original stack.

When the conveying force adjusting means includes the servo motor or the stepping motor, by providing the original biasing means at the acting point of the servo motor or the stepping motor via the elastic member or by rotatably supporting the feed roller at the acting point, since the displaced amount of the elastic member or the protruding amount of the feed roller into the original convey path can be adjusted to adjust the original conveying force, the fine conveying force adjustment can be realized.

When the conveying force adjusting means comprises the solenoid having the plunger, by driving the original biasing means by the energization of the solenoid through the elastic member connected to the plunger or by rotatably supporting the feed roller at the acting point of the solenoid, since the displaced amount of the elastic member or the protruding amount of the feed roller into the original convey path can be adjusted to adjust the conveying force toward the "strong" side or the "weak" side, the apparatus can be made cheaper.

In the original supplying apparatus having the original conveying force adjusting device, the convey means for conveying the separated original to the predetermined position of the original reading means, and the motor for driving both the separation means and the convey means, by providing the original conveying force adjusting means wherein the conveying force is increased when the weight of the original stack detected in the original stacking means is heavy and the conveying force is decreased when the weight of the original stack is light, the originals can be separated and conveyed with the proper original conveying force depending upon the weight of the original stack.

When the original conveying force adjusting means includes the lever mechanism, by connecting one end of the lever to the original stacking means displaced in accordance with the weight of the original stack and connecting the other end of the lever to the spring for biasing the roller in the original convey portion so that the original conveying force adjusting means is shifted to decrease the roller biasing force when the level of the original stacking means is high and to increase the roller biasing force when the level of the original stacking means is low, the detection of the weight of the original stack and the adjustment of the conveying force can be performed only mechanically, and the apparatus can be made cheaper because of no electrical means.

By providing the extensions on the original supply ends of the ribs and by rotatably supporting the shaft of the feed roller (to be contacted with the lower surface of the original stack) on the extensions via the bearings so that, when the ribs are lowered by the weight of the original stack, the feed roller is lifted to increase the contact pressure between the lower surface of the original stack and the feed roller, the poor original supply which may be caused by the deformation of the original convey path at the entrance thereof by the action of the original weight detecting means can be prevented.

By providing the extensions on the original supply ends of the ribs and by providing the original urging member and associated biasing means (spring) above the original convey path in a confronting relation to the feed roller (to be contacted with the lower surface of the original stack) and by fixing the end of the spring to the lever rotatably (in the original conveying direction) supported on a conveying path support frame including the upper original guide and by widening the other end of the lever out of the original convey path to abut the other end against the extensions of the ribs above and below the original convey path, the level of the feed roller can always be kept constant to provide the constant nip for the original stack and at the same time the conveying force can be adjusted by adjusting the biasing force of the biasing means opposed to the feed roller.

By rotatably supporting the upper and lower original guides near the discharge opening so that the end of the lever is separated from the rib extensions when the original convey path is opened, the original jam treatment can easily be performed.

What is claimed is:

1. A sheet supplying apparatus comprising:

a stacking means on which a plurality of sheets can be stacked as a sheet stack, at least a portion of said stacking means being shiftable in a stacking direction in accordance with the weight of the sheet stack;

a supply means for supplying the sheets to be stacked on said stacking means; and an adjusting means for adjusting a supplying force of said supply means in response to a shifted amount of said stacking means, irrespective of a size of the sheets.

2. A sheet supplying apparatus according to claim 1, wherein said stacking means and said adjusting means are interconnected through a connecting means.

3. A sheet supplying apparatus according to claim 2, wherein said supply means has a rotary member rotated in a supplying direction and an urging means for urging the sheets against said rotary member, and said adjusting means acts as a means for changing an urging force of said urging means when said stacking means is shifted.

4. A sheet supplying apparatus according to claim 3, further comprising an electrically operated means for urging said rotary member against said urging means.

5. A sheet supplying apparatus according to claim 2, wherein said supply means includes a rotary member rotated in a supplying direction and an urging means for urging the sheets against said rotary member, and said adjusting means acts as a means for changing a force for shifting said rotary member toward said urging means when said stacking means is shifted.

6. A sheet supplying apparatus according to claim 5, further comprising an electrically operated means provided on said adjusting means for urging said rotary member against said urging means.

7. A sheet supplying apparatus according to claim 1, further comprising a sensor means for detecting a weight of the sheet stack on said stacking means, wherein the shifted amount of said stacking means is electrically detected by said sensor means, and said adjusting means is shifted by an electrically-operated means.

8. A sheet supplying apparatus according to claim 7, wherein the shifted amount of said stacking means is detected as one of two values, i.e. heavy or light.

9. A sheet supplying apparatus according to claim 8, wherein said supply means includes a rotary member rotated in a supplying direction and an urging means for urging the sheets against said rotary member, and said adjusting means acts as a means for changing an urging force of said urging means when said stacking means is shifted by ON/OFF of said electrically operated means.

10. A sheet supplying apparatus according to claim 9, further comprising a second electrically operated means for urging said rotary member against said urging means.

11. A sheet supplying apparatus according to claim 8, wherein said supply means includes a rotary member rotated in a supplying direction and an urging means for urging the sheets against said rotary member; and said adjusting means acts as a means for changing a force for shifting said rotary member toward said urging means when said stacking means is shifted by ON/OFF of said electrically operated means.

12. A sheet supplying apparatus according to claim 11, further comprising a second electrically-operated means for urging said rotary member against said urging means.

13. A sheet supplying apparatus according to claim 8, wherein sensor means for detecting the shifted amount of said stacking means is a photo-interrupter, and said stacking means is provided with a slit means so that the shifted amount of said stacking means is detected by detecting said slit means by said photo-interrupter.

14. A sheet supplying apparatus according to claim 7, wherein the shifted amount of said stacking means is detected in a multi-stage manner by said sensor means.

15. A sheet supplying apparatus according to claim 14, wherein said supply means includes a rotary member rotated in a supplying direction and an urging means for urging the sheets against said rotary member, and said adjusting means acts as a means for changing an urging force of said urging means when said stacking means is shifted by said electrically operated means.

16. A sheet supplying apparatus according to claim 15, further comprising a second electrically-operated means for urging said rotary member against said urging means.

17. A sheet supplying apparatus according to claim 14, wherein said supply means includes a rotary member rotated in a supplying direction and an urging means for urging the sheets against said rotary member, and said adjusting means acts as a means for changing a force for shifting said rotary member toward said urging means when said stacking means is shifted by said electrically operated means.

18. A sheet supplying apparatus according to claim 17, further comprising a second electrically operated means for urging said rotary member against said urging means.

19. A sheet supplying apparatus according to claim 14, wherein said sensor means for detecting the shifted amount of said stacking means is a photo-interrupter, and said stacking means is provided with a plurality of slits so that the shifted amount of said stacking means is detected by detecting one of said slits by means of said photo-interrupter.

20. A sheet supplying apparatus according to claim 1, wherein said stacking means is an entirely movable member.

21. A sheet supplying apparatus according to claim 20, wherein said supply means includes a rotary member rotated in a supplying direction and an urging means for urging the sheets against said rotary member, and said adjusting means acts as a means for changing a force for shifting said rotary member toward said urging means when said stacking means is shifted.

22. A sheet supplying apparatus according to claim 21, wherein an electrically operated means for urging said rotary member against said urging means is provided on said adjusting means.

23. A sheet supplying apparatus according to claim 1, wherein said stacking means has a fixed member, and a rib-shaped movable member shiftable within a slot formed in said fixed member.

24. A sheet supplying apparatus according to claim 1, further comprising a sensor means for detecting a weight of the sheet stack on said stacking means and an electrically-operated means wherein said sensor means is a piezo-electric element which detects the weight of the original stack rested on said stacking means as a displacement of said piezo-electric element, and said adjusting means is shifted by said electrically-operated means.

25. A sheet supplying apparatus according to claim 24, wherein said supply means includes a rotary member rotated in a supplying direction and an urging means for urging the sheets against said rotary member, and said adjusting means acts as a means for changing an urging force of said urging means by said electrically-operated means when said stacking means is shifted.

26. A sheet supplying apparatus according to claim 24, wherein said supply means includes a rotary member rotated in a supplying direction and a urging means for urging the sheets against said rotary member, and said adjusting means acts as a means for changing a force for shifting said rotary member toward said urging means by said electrically-operated means when said stacking means is shifted.

27. A sheet supplying apparatus according to claim 1, wherein said supply means includes a rotary member rotated in a supplying direction and an urging means for urging the sheet against said rotary member from the above, and said adjusting means acts as a means for changing an urging force of said urging means.

28. A sheet supplying apparatus according to claim 27, wherein said urging means can be shifted in accordance with the thickness of the original stack to change an urging force.

29. A sheet supplying apparatus according to claim 27, further comprising a pair of separation/supply means disposed downstream of said rotary member to separate the sheets conveyed by said rotary member one by one and to supply the separated sheets.

30. A sheet supplying apparatus according to claim 1, wherein said supply means includes a rotary member rotated in a supplying direction and an urging means for urging the sheet against said rotary member from the above, and said adjusting means acts as a means for changing a force for shifting said rotary member toward said urging means.

31. A sheet supplying apparatus according to claim 30, wherein said urging means can be shifted in accordance with the thickness of the original stack to change an urging force.

32. A sheet supplying apparatus according to claim 30, further comprising a pair of separation/supply means disposed downstream of said rotary member to separate the sheets conveyed by said rotary member one by one and to supply the separated sheets.

33. A sheet supplying apparatus according to claim 3, wherein said urging means is rockable, said adjusting means is rockable and acts onto said urging means via a spring, and said connecting means is rocked by a rocking operation of said stacking means to thereby rock said adjusting means.

34. A sheet supplying apparatus according to claim 27, wherein said urging means is rockable, said adjusting means is rockable and acts onto said urging means via a spring, and said connecting means is rocked by a rocking operation of said stacking means to thereby rock said adjusting means.

35. A sheet supplying apparatus according to claim 30, wherein said rotary member is rockably supported by an arm, and said connecting means rocks said arm by a rocking operation of said stacking means.

36. A sheet reading apparatus comprising:

a stacking means on which a plurality of sheets can be stacked as a sheet stack;

a supply means for supplying the sheets to be stacked on said stacking means;

a sensor means for detecting a weight of the sheet stack on said stacking means;

an adjusting means for adjusting a supplying force of said supply means in accordance with the weight of the sheet stack, irrespective of a size of the sheets; and a reading means for reading the supplied sheet.

37. A facsimile apparatus comprising:

a stacking means on which a plurality of sheets can be stacked as a sheet stack;

a supply means for supplying the sheet on said stacking means;

a sensor means for detecting a weight of the sheet stack on said stacking means;

an adjusting means for adjusting a supplying force of said supply means in accordance with the weight of the sheet stack, irrespective of a size of the sheet;

a reading means for reading the supplied sheet; and a transmission means for transmitting information on the sheet read by said reading means.

38. A sheet supplying apparatus comprising:

a stacking means on which a plurality of sheets can be stacked as a sheet stack, at least a portion of said stacking means being shiftable in a stacking direction, dependent on a weight of the sheet stack, but independent of the thickness of the sheet stack;

a supply means for supplying the sheets to be stacked onto said stacking means; and an adjusting means for adjusting a supplying force of said supply means in response to a shifted amount of said stacking means.

39. A sheet supplying apparatus comprising:

a stacking means on which a plurality of sheets can be stacked as a sheet stack, at least a portion of said stacking means being shiftable in a stacking direction, in response to a sheet size and a sheet stack weight;

a supply means for supplying a sheet to be stacked on said stacking means; and an adjusting means for adjusting a supplying force of said supplying means in response to a shifted amount of said stacking means.

40. A sheet reading apparatus comprising:

a stacking means on which a plurality of sheets can be stacked as a sheet stack, at least a portion of said stacking means being shiftable in a stacking direction in accordance with the weight of the sheet stack;

a supply means for supplying the sheets to be stacked on said stacking means;

adjusting means for adjusting a supplying force of said supply means in response to a shifted amount of said stacking means, irrespective of a size of the sheets, and a reading means for reading the supplied sheet.

41. A facsimile apparatus comprising:

a stacking means on which a plurality of sheets can be stacked as a sheet stack, at least a portion of said stacking means being shiftable in a stacking direction in accordance with the weight of the sheet stack;

a supply means for supplying the sheets to be stacked on said stacking means;

an adjusting means for adjusting a supplying force of said supply means in response to a shifted amount of said stacking means, irrespective of a size of the sheets;

a reading means for the supplied sheet; and a transmission means for transmitting information read by said reading means.

* * * * *

UNITED STATES PATENT AND TRADEMARK OFFICE

CERTIFICATE OF CORRECTION

PATENT NO. : 5,951,002
DATED : September 14, 1999
INVENTOR(S) : Masahiko Yokota

It is certified that error appears in the above-identified patent and that said Letters Patent is hereby corrected as shown below:

Column 4:
Line 56, "performed" should read --performed,--.

Column 8:
Line 7, "spacial" should read --spatial--.

Column 9:
Line 5, "synchronous" should read --synchronism--.

Column 14:
Line 13, "a" (sencond occurrence) should read --an--;
Line 21, "the" should be deleted; and
Line 36, "the" should be deleted.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*